US008289254B2

(12) United States Patent
Oomura

(10) Patent No.: US 8,289,254 B2
(45) Date of Patent: Oct. 16, 2012

(54) LIQUID CRYSTAL DISPLAY APPARATUS, DRIVE METHOD THEREOF, AND LIQUID CRYSTAL PROJECTION APPARATUS

(75) Inventor: Masanobu Oomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 939 days.

(21) Appl. No.: 12/349,815

(22) Filed: Jan. 7, 2009

(65) Prior Publication Data

US 2009/0190047 A1 Jul. 30, 2009

(30) Foreign Application Priority Data

Jan. 29, 2008 (JP) ..... 2008-018063

(51) Int. Cl.
*G09G 3/36* (2006.01)

(52) U.S. Cl. ..... 345/90; 345/100

(58) Field of Classification Search ..... 345/87–104
See application file for complete search history.

(56) References Cited

U.S. PATENT DOCUMENTS

| | | | | |
|---|---|---|---|---|
| 6,417,830 | B1 * | 7/2002 | Byeon, II | 345/99 |
| 7,973,868 | B2 | 7/2011 | Kameyama et al. | |
| 2006/0050043 | A1 | 3/2006 | Kawagoe | |
| 2007/0279353 | A1 | 12/2007 | Oomura | 345/87 |
| 2008/0174580 | A1 * | 7/2008 | Chang et al. | 345/205 |
| 2008/0198290 | A1 * | 8/2008 | Su et al. | 349/48 |
| 2008/0259229 | A1 | 10/2008 | Oomura et al. | 345/5 |

FOREIGN PATENT DOCUMENTS

| | | | |
|---|---|---|---|
| EP | 0 911 796 | A1 | 4/1999 |
| JP | 2004-258498 | A | 9/2004 |
| JP | 2005-78024 | A | 3/2005 |
| JP | 2006-72078 | A | 3/2006 |

OTHER PUBLICATIONS

Japanese Office Action dated Jul. 24, 2012, in counterpart Japanese Application No. 2008-018063, and partial English-language translation thereof.

* cited by examiner

*Primary Examiner* — Jimmy H Nguyen
(74) *Attorney, Agent, or Firm* — Fitzpatrick, Cella, Harper & Scinto

(57) ABSTRACT

A liquid crystal display apparatus includes: a plurality of pixels arranged in a matrix, each including a switching element connected to a pixel electrode for applying a voltage to a liquid crystal placed between the pixel electrode and a counter electrode; and a vertical scan circuit for supplying a scan signal for controlling the switch element between conducting and non-conducting states, and for scanning the pixels scan line by scan line sequentially, wherein the scan signal includes a first conducting signal setting the switch element at the conducting state, a second conducting signal setting the switch element at the conducting state following to the first conducting signal, and a non-conducting signal setting the switch element at the non-conducting state between the first and second conducting signals to suppress deterioration of the image quality owing to the parasitic capacitance coupling between pixel electrodes and a feedthrough between pixels.

6 Claims, 8 Drawing Sheets

LIQUID CRYSTAL DISPLAY APPARATUS, DRIVE METHOD THEREOF, AND LIQUID CRYSTAL PROJECTION APPARATUS

BACKGROUND OF THE INVENTION

1. Field of the Invention

The present invention relates to a liquid crystal display apparatus, a drive method thereof, and a liquid crystal projection apparatus.

2. Description of the Related Art

As an image display apparatus using an active matrix substrate, a liquid crystal display apparatus is known, and the liquid crystal display apparatus is widely adopted to a liquid crystal projector, a liquid crystal display, and the like. As is well known, such a liquid crystal display apparatus using an active matrix substrate includes pixel cells arranged in a matrix on, for example, a semiconductor substrate, and each of the pixel cells includes a pixel switch made of a metal oxide semiconductor (MOS) transistor and a pixel capacitor connected to the pixel switch. That is, a plurality of scan lines is arranged along horizontal directions, and a plurality of signal lines is arranged along vertical directions. Then, a pixel cell is connected to each of the intersection points of the scan lines and the signal lines. Then, a common electrode substrate is placed opposite to the semiconductor substrate, and a liquid crystal is enclosed between the semiconductor substrate and the common electrode substrate, whereby a liquid crystal display apparatus is formed.

A recent liquid crystal display apparatus has been required to heighten the resolution thereof and extend the definition thereof simultaneously. As the related art capable of realizing the requirement, for example, the related art disclosed in the following patent publication can be given.

That is, European Patent Application Publication No. 0911796 describes the realization of both of the extension of definition and a high speed operation. In order to realize the extension of definition and the high speed operation, the related art disclosed in the patent publication performs vertical scan while turning on (driving) a plurality of rows of pixel switches simultaneously, thereby avoiding the generation of any feedthroughs through parasitic capacitance to the next row pixels at the time of voltage writing.

SUMMARY OF THE INVENTION

However, the related art described above has the following problem. That is, in the vertical scan drive, which turns on a plurality of rows simultaneously to write voltages into a plurality of pixels on the same column, a pixel defect of a pixel originally becomes a connected pixel defect of a plurality of connected pixels if the pixel is short-circuited to any of a power supply, the ground (GND), and a reference voltage. As a result, a remarkable image quality deterioration is caused.

A cause of the occurrence of the connected pixel defect is as follows. For example, a case is examined in which a vertical scan drive is performed with the pixels on both of an $N^{th}$ row and an $(N+1)^{th}$ row turned on simultaneously and a pixel on the $(N+1)^{th}$ row is short-circuited to the GND.

When the pixel switches on the $N^{th}$ row become in their on-states by the scan line on the $N^{th}$ row and voltage writing can be performed, the pixel switches on the $(N+1)^{th}$ row simultaneously become in their on-states by the scan line on the $(N+1)^{th}$ row. In this state, since a pixel on the $N^{th}$ row and a pixel on the $(N+1)^{th}$ row are in the state of being short-circuited with each other through a signal line, it is impossible to write a normal voltage into the pixel on the $N^{th}$ row owing to the influence of the pixel on the $(N+1)^{th}$ row. As a result, the pixel voltage on the $N^{th}$ row becomes the GND potential.

When the voltage writing into the pixel on the next $(N+1)^{th}$ row is performed after the completion of the voltage writing into the pixels on the $N^{th}$ row, the pixel on the $(N+1)^{th}$ row naturally takes the GND potential. When the voltage writing is being performed into the pixel on the $(N+1)^{th}$ row, the GND potential is also written into a pixel on a $(N+2)^{th}$ row. But, when the voltage writing is performed into the $(N+2)^{th}$ row after the completion of the voltage writing onto the pixels on the $(N+1)^{th}$ row, the pixel on the $(N+2)^{th}$ row is rewritten to a normal voltage. Consequently, a two-connected pixel defect is caused in the vertical scan drive, which turns on two rows simultaneously.

The present invention is directed to suppress the deteriorations of an image quality owing to parasitic capacitance coupling between pixel electrodes and a feedthrough between pixels, and to suppress the deterioration of the image quality owing to the occurrence of a pixel defect over a plurality of rows.

A liquid crystal display apparatus according to the present invention is a liquid crystal display apparatus comprising: a plurality of pixels arranged in a matrix, wherein each of the pixels includes a switch element connected to a pixel electrode for applying a voltage to a liquid crystal placed between the pixel electrode and a counter electrode; a plurality of scan lines arranged in a column direction, wherein each of the scan lines is connected commonly to the plurality of switch elements arranged in the row direction; and a vertical scan circuit for supplying the scan line with a scan signal for controlling the switch element between an conducting state and a non-conducting state, and for scanning the pixels scan line by scan line sequentially, wherein the scan signal includes a first conducting signal setting the switch element at the conducting state, a second conducting signal setting the switch element at the conducting state following to the first conducting signal, and a non-conducting signal setting the switch element at the non-conducting state between the first and second conducting signals, and the vertical scan circuit supplies a predetermined scan line with the second conducting signal, while supplying, with the first conducting signal and the non-conducting signal, the other scan line to be scanned next to the predetermined scan line.

Moreover, a method of driving a liquid crystal display apparatus according to the present invention is a method of scanning, scan line by scan line sequentially, a plurality of pixels arranged in a matrix, wherein each of the pixels includes a switch element connected to a pixel electrode for applying a voltage to a liquid crystal placed between the pixel electrode and a counter electrode, by supplying a plurality of scan lines arranged in a column direction, wherein each of the scan lines is connected commonly to the plurality of switch elements arranged in the row direction, with a scan signal for controlling the switch element between an conducting state and a non-conducting state, wherein the scan signal includes a first conducting signal setting the switch element at the conducting state, a second conducting signal setting the switch element at the conducting state following to the first conducting signal, and a non-conducting signal setting the switch element at the non-conducting state between the first and second conducting signals, and wherein the method comprising a step of supplying a predetermined scan line with the second conducting signal, while supplying, with the first conducting signal and the non-conducting signal, the other scan line to be scanned next to the predetermined scan line.

The present invention can suppress the deteriorations of image quality owing to the parasitic capacitance coupling between pixel electrodes and a feedthrough between pixels, and can suppress the deterioration of the image quality owing to the occurrence of a pixel defect over a plurality of rows.

Further features of the present invention will become apparent from the following description of exemplary embodiments with reference to the attached drawings.

DESCRIPTION OF THE EMBODIMENTS (First Embodiment)

Figure 3:
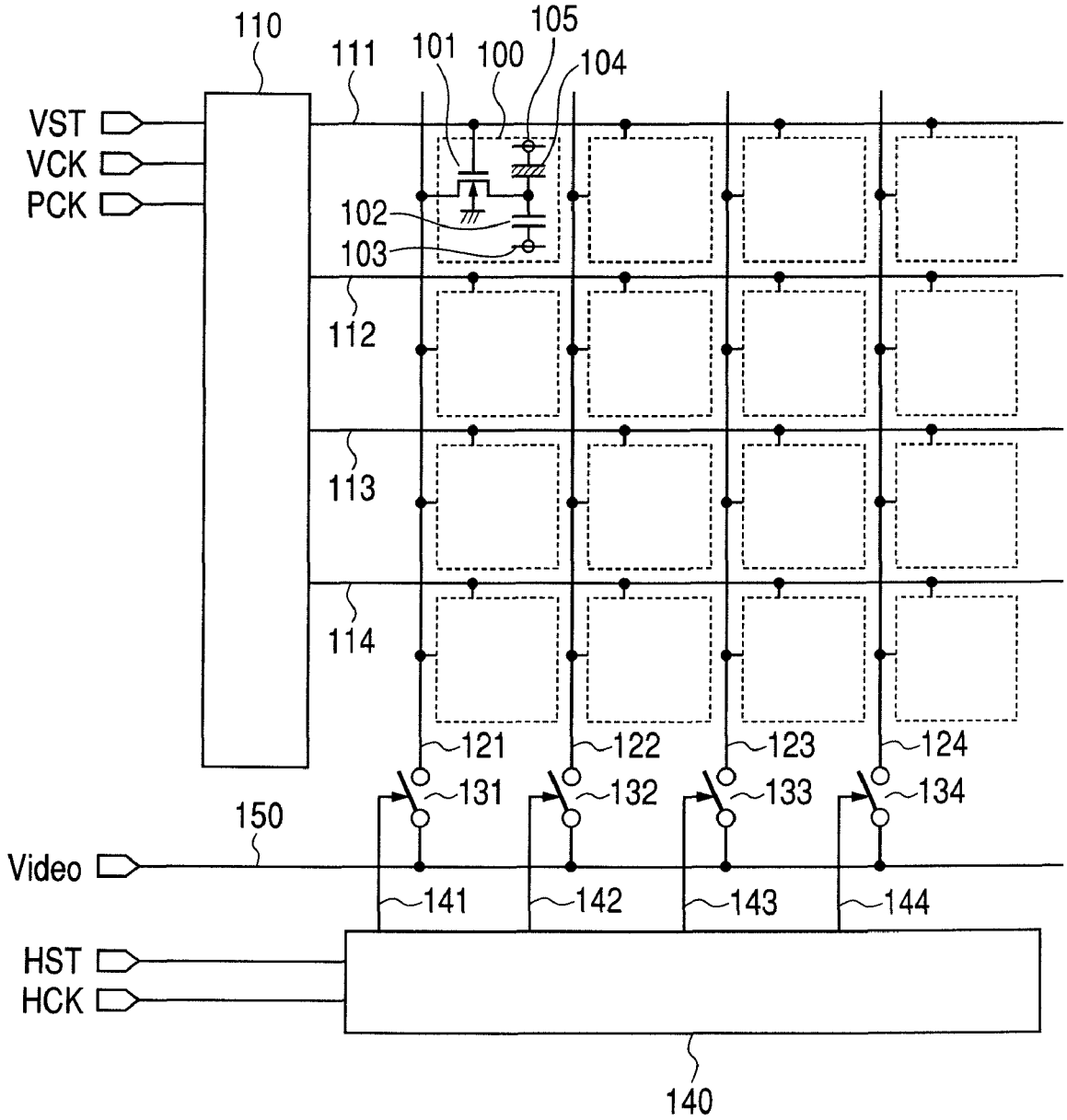
FIG. 3 is a diagram illustrating a circuit example of a liquid crystal display apparatus in the first embodiment of the present invention.

FIG. 3 is a diagram illustrating a circuit example of a liquid crystal display apparatus by a first embodiment of the present invention. In the following, the liquid crystal display apparatus and a drive method thereof will be described. The liquid crystal display apparatus includes a plurality of unit pixels 100 constituting the display area of the liquid crystal display apparatus. The unit pixels 100 are arranged in a matrix, each including a switch element 101, a pixel holding capacitor 102, and a liquid crystal 104. A MOS transistor is used as the switch element 101 in the present embodiment here. The counter electrode of the pixel holding capacitor 102 is at a first reference voltage 103, which is commonly used for all of the pixels. Although not illustrated, an electrode is arranged at a connection end of the switch element 101 and the pixel holding capacitor 102, and the liquid crystal 104 is arranged to be put between the electrode and a transparent electrode, which is used as a common electrode to all of the pixels and is connected to a second reference voltage 105.

In the pixels 100 arranged in the matrix, the control terminals of the plurality of switch elements 101 in each row direction are severally connected to each of the same scan lines 111 to 114 in common. The gates of the transistors are used as the control terminals of the switch elements 101 of the present embodiment here. Then, one ends of the plurality of switch elements 101 in each column direction are severally connected to each of the same signal lines 121 to 124 in common. The sources of the transistors are used as the one ends of the switch elements 101 of the present embodiment here.

Switch circuits (hereinafter referred to as transfer switches) 131 to 134 are connected to the signal lines 121 to 124, respectively. The other ends of the transfer switches 131 to 134 are connected to a video signal line 150. An analog voltage according to an image desired to be displayed is input into the video signal line 150.

The control terminals of the transfer switches 131 to 134 are controlled by output signals 141 to 144, respectively, of a horizontal scan circuit 140.

A horizontal scan start signal HST and a horizontal scan clock signal HCK are input into the horizontal scan circuit 140. The horizontal scan circuit 140 is made up of shift registers, and the detailed configuration and operation thereof are clarified by many publicly known documents. The description of the configuration of the horizontal scan circuit 140 is accordingly omitted here.

The scan lines 111 to 114 are controlled by a vertical scan circuit 110. A vertical scan start signal VST, a vertical scan clock signal VCK, and a control clock signal PCK are input into the vertical scan circuit 110. The vertical scan start signal VST is a signal for making the vertical scan circuit 110 start a vertical scan. The vertical scan clock signal VCK is a signal for regulating the timing of a vertical scan of the vertical scan circuit 110. The control clock signal PCK is used as an original signal at the time of generating preliminary charging pulse signals, which will be described later.

Figure 4:
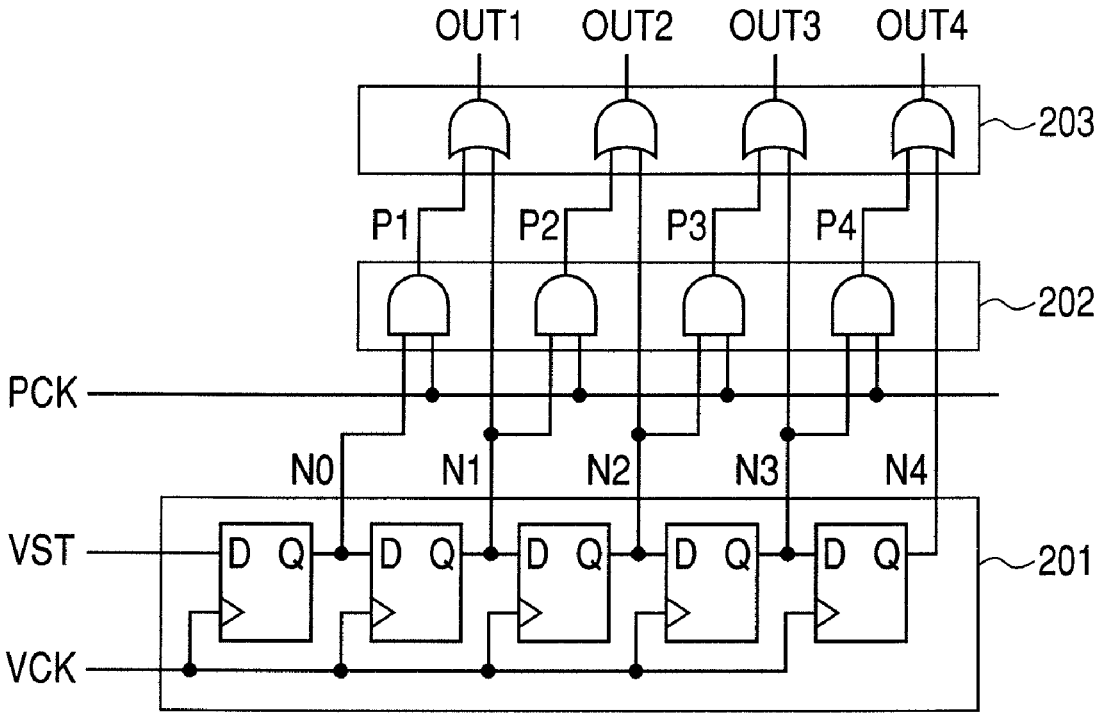
FIG. 4 is a diagram illustrating a configuration example of the vertical scan control circuit in the first embodiment of the present invention.

FIG. 4 illustrates an example of the configuration of the vertical scan circuit 110 in the present embodiment. The vertical scan circuit 110 includes a shift register circuit 201, made up of D flip flop (hereinafter referred to as DFF) circuits, a first signal generating circuit 202, made up of AND circuits for generating the preliminary charging pulse signals, and a second signal generating circuit 203, made up of OR circuits for generating scan signals.

An output signal N0 of a first stage DFF circuit constituting the shift register circuit 201 is input into an input terminal of a first row AND circuit of the first signal generating circuit 202. Moreover, the control clock signal PCK is input into the other input terminals of all of the AND circuits of the first signal generating circuit 202. The first row AND circuit outputs an output signal P1, which is a logical product signal based on the output signal N0 of the shift register circuit 201 and the control clock signal PCK. The output signal P1 is input into an input terminal of a first row OR circuit of the second signal generating circuit 203. An output signal Pn of the first signal generating circuit 202 is referred to as a preliminary charging pulse signal here. Then, an output signal N1 of a second stage DFF circuit is input into the other input terminal of the first row OR circuit. The first row OR circuit outputs an output signal OUT1, which is a logical sum signal based on the output signal P1 of the first signal generating circuit 202 and the output signal N1 of the shift register circuit 201. The output signal OUT1 is supplied to the first row scan line 111. An output signal OUTn of the second signal generating circuit 203 is referred to as a scan signal here.

Moreover, the output signal N1 of the second stage DFF circuit is also input into an input terminal of a second row AND circuit of the first signal generating circuit 202. The second row AND circuit outputs an output signal P2, which is a logical product signal based on the output signal N1 of the shift register circuit 201 and the control clock signal PCK. The output signal P2 is input into an input terminal of the second row OR circuit of the second signal generating circuit 203. Then, an output signal N2 of a third stage DFF circuit is input into the other input terminal of the second row OR circuit. The second row OR circuit outputs an output signal OUT2, which is a logical sum signal based on the output signal P2 of the first signal generating circuit 202 and the output signal N2 of the shift register circuit 201. The output signal OUT2 is supplied to the second row scan line 112.

Furthermore, the output signal N2 of the third stage DFF circuit is also input into an input terminal of a third row AND circuit of the first signal generating circuit 202. The third row AND circuit outputs an output signal P3, which is a logical product signal of the output signal N2 of the shift register circuit 201 and the control clock signal PCK. The output signal P3 is input into an input terminal of a third row OR circuit of the second signal generating circuit 203. Then, an output signal N3 of a fourth stage DFF circuit is input into the other input terminal of the third row OR circuit. The third row OR circuit outputs an output signal OUT3, which is a logical sum signal of the output signal P3 of the first signal generating circuit 202 and the output signal N3 of the shift register circuit 201. The output signal OUT3 is supplied to a third row scan line 113.

Then, the output signal N3 of the fourth stage DFF circuit is input into an input terminal of a fourth row AND circuit of the first signal generating circuit 202. The fourth row AND circuit outputs an output signal P4, which is a logical product signal of the output signal N3 of the shift register circuit 201 and the control clock signal PCK. The output signal P4 is input into an input terminal of a fourth row OR circuit of the second signal generating circuit 203. Then, an output signal N4 of a fifth stage DFF circuit is input into the other input terminal of the fourth row OR circuit. The fourth row OR circuit outputs an output signal OUT4, which is a logical sum signal of the output signal P4 of the first signal generating circuit 202 and the output signal N4 of the shift register circuit 201. The output signal OUT4 is supplied to a fourth row scan line 114.

In such a way, each of the output signals OUT1-OUT4, which are generated by the vertical scan circuit 110 and are output from the vertical scan circuit 110, includes a first conducting signal setting the switch elements 101 at conducting states, and a second conducting signal setting the switch elements 101 at conducting states following to the first conducting signal. Moreover, each of the output signals OUT1-OUT4 includes non-conducting signal setting the switch elements 101 at non-conducting states between the first conducting signal and the second conducting signal. In other words, the vertical scan circuit 110 applies two conducting signals and one non-conducting signal between them to one scan line for one vertical scan period.

Moreover, in a period during which the vertical scan circuit 110 is supplying a predetermined scan line, for example, the first row scan line 111, with the second conducting signal, the vertical scan circuit 110 supplies, with the first conducting signal and the non-conducting signal, the second row scan line 112 to be scanned next to the first row scan line 111. In the following, the operation will be minutely described. Incidentally, the conducting signal indicates a pulsed signal having a conducting voltage to change a switch element to be in its conducting state for a predetermined period. Moreover, the non-conducting signal indicates a signal having a non-conducting voltage to change a switch element to be in its non-conducting state for a predetermined period.

Figure 1:
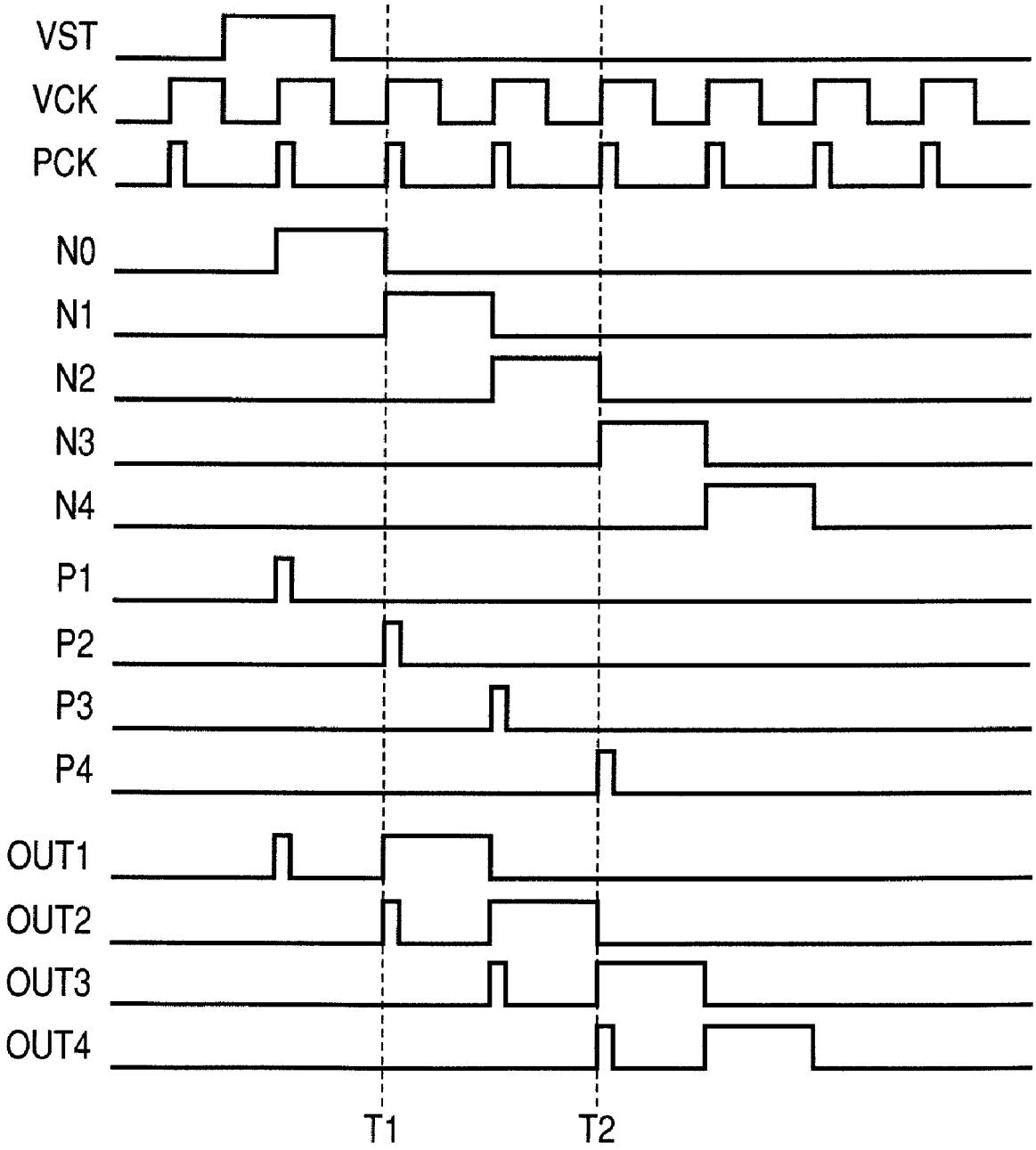
FIG. 1 is a timing chart illustrating an operation example of a vertical scan control circuit in a first embodiment of the present invention.

FIG. 1 is a timing chart illustrating an operation example (drive method) of the vertical scan circuit 110 illustrated in FIG. 4. The vertical scan start signal VST, the vertical scan clock signal VCK, and the control clock signal PCK are input into the vertical scan circuit 110. The output signals N0-N4 are output from the DFF circuits in the shift register circuit 201. The output signals P1-P4 are output from the AND circuits in the first signal generating circuit 202. The output signals OUT1-OUT4 are output from the OR circuits in the second signal generating circuit 203 as the scan signals.

It is important here that the control clock signal PCK is a signal synchronized with the vertical scan clock signal VCK, and having a duty cycle that has a shorter high (Hi) level period than that of the vertical scan clock signal VCK to be different from that of the vertical scan clock signal VCK. The Hi level period determines the preliminary charging operation. Moreover, the timing of the Hi level period of the control clock signal PCK is also important.

Figure 2:
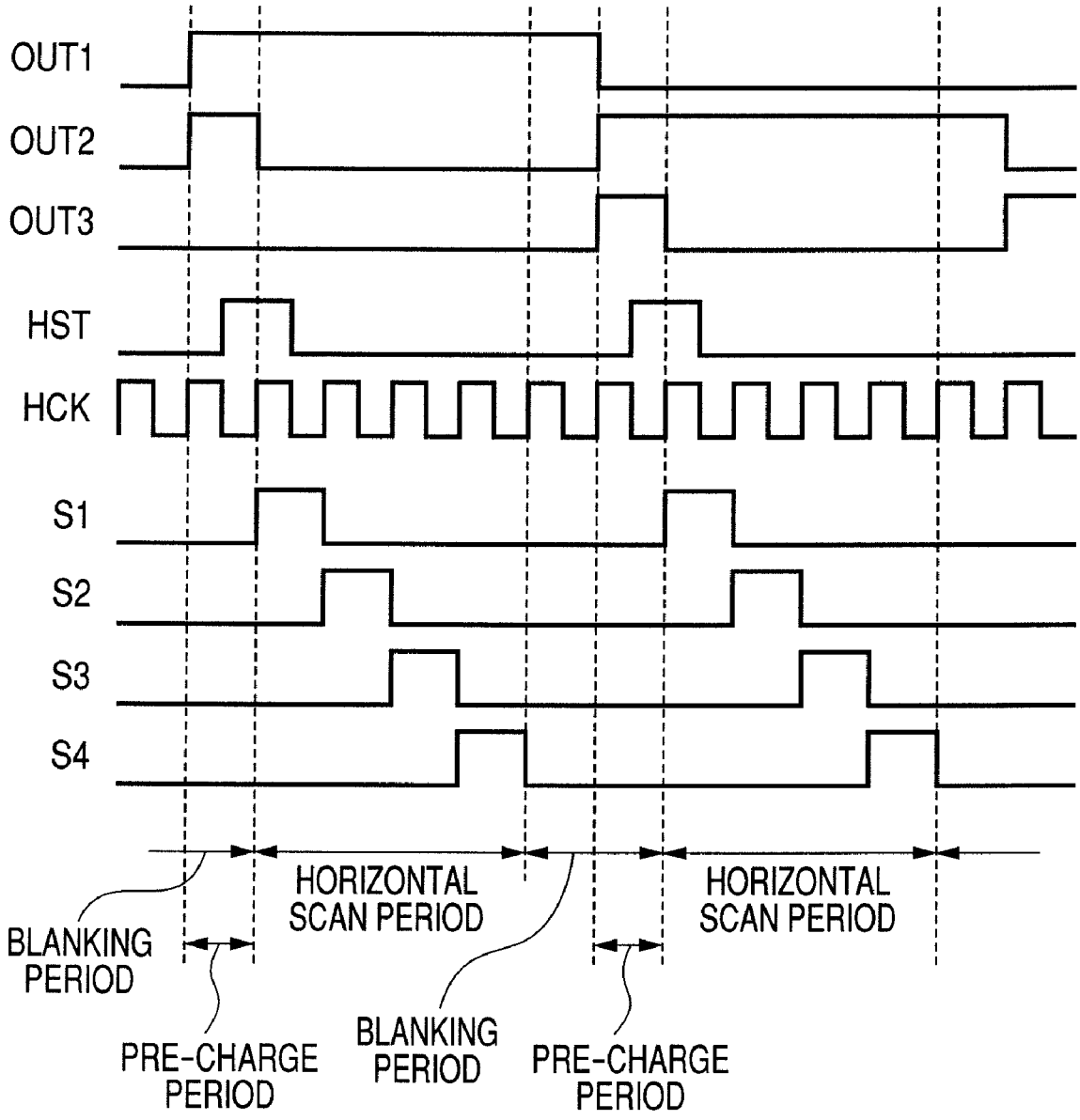
FIG. 2 is an enlarged view of a timing chart illustrating an operation example of the vertical scan control circuit in the first embodiment of the present invention.

FIG. 2 is a timing chart illustrating a preliminary charging period in the present embodiment by enlarging a time period from T1 to T2 in FIG. 1. In FIG. 2, the horizontal scan start signal HST, the horizontal scan clock signal HCK, and the output signals 141-144, which are transfer switch control signals S1-S4, respectively, are also contained. The horizontal scan start signal HST is a signal for making the horizontal scan circuit 140 start a horizontal scan here. The horizontal scan clock signal HCK is a signal for regulating the timing of the horizontal scans of the horizontal scan circuit 140.

As illustrated in FIG. 2, the period capable of performing a preliminary charging operation is a time period from the time when the scan line 112 changes to the Hi level to the time when a horizontal scan period is started. The preliminary charging operation indicates an operation of applying a signal voltage, which is to be applied to a predetermined pixel, to a pixel, to which the signal voltage is to be applied at the timing different from that of applying the signal voltage to the predetermined pixel, in advance here. A period from starting the preliminary charging operation to completing it is referred to as a preliminary charging operation period. The period during which the control clock signal PCK is in the state of being at the Hi level is the preliminary charging operation period, and the preliminary charging operation period can be controlled by changing the period of being the Hi level or the phase to the vertical scan clock signal VCK here.

Next, the operation of the present embodiment will be described. A case where a pixel on the second row is short-circuited to the GND is examined, for example. The vertical scan circuit 110 applies the second conducting signal of the scan signal OUT1 to the first row scan line 111, and the first row scan line 111 changes to be the Hi level, which is the conducting voltage. Thereby, the pixels on the first row change to be the state in which voltages can be written. On this occasion, the vertical scan circuit 110 applies the first conducting signal of the scan signal OUT2 to the second row scan line 112, and the second row scan line 112 changes to be the Hi level. Thereby, the preliminary charging operation is performed. Since the second row pixel is short-circuited to the GND at this time, the GND potential is written into the corresponding first row pixel. If the vertical scan is performed as it is, then the first row pixel is left to be the GND potential, and the voltage that should be originally written into the pixel is not written into the pixel, and also the first row pixel becomes a display defect. The vertical scan circuit 110 accordingly supplies a non-conducting signal to the scan line 112 by the scan signal OUT2 during a period in which the second conducting signal is supplied to the scan line 111 after the application of the first conducting signal to the scan line 112 and before the end of the supply of a voltage based on a video signal to the pixel on the preceding row. More preferably, the vertical scan circuit 110 supplies the non-conducting signal to the scan line 112 by the scan signal OUT2 during the period in which the second conducting signal is supplied to the scan line 111 after the application of the first conducting signal to the scan line 112 and before the start of a horizontal scan. Consequently, since the preliminary charging operation ends before the start of the horizontal scan, the pixels on the first and second rows become in an electrically blocking state from each other in the period in which the horizontal scan is performed. By the execution of the horizontal scan in the state in which the first and second row pixels are electrically in a blocking state from each other, when a voltage that should be originally written into the pixel is input from the video signal line 150, the pixel on the first row is rewritten by the voltage.

The preliminary charging voltage at the execution of the preliminary charging operation is performed at the potential held in the signal lines 121-124 here. Moreover, since the capacity of the signal lines 121 to 124 is several pF and the capacity of the pixel holding capacitor 102 is several tens fF, the capacity of the signal lines 121 to 124 is sufficiently larger than that of the pixel holding capacitor 102. Consequently, the preliminary charging operation can be performed.

Incidentally, if the preliminary charging operation is performed during the horizontal scan period or during the blanking period after the horizontal scan, then adjoining pixels short-circuit to each other through the signal lines 121 to 124 similarly to the case of the related art, and the problem of the related art cannot be settled.

Moreover, by using the preliminary charging operation of the present embodiment, no pixel voltages change from their positive fields to their negative fields and vice versa at a stretch, and consequently the amount of voltage changes can be made to be little. The influences of a feedthrough to an adjacent pixel through parasitic capacitance can thereby be suppressed.

Incidentally, the present embodiment can be applied to a liquid crystal display apparatus using an active matrix substrate for performing a field inversion drive.

As described above, by using the configuration illustrated in the present embodiment, the preliminary charging to a pixel on the $(N+1)^{th}$ row is ended during the performance of writing into the pixels on the $N^{th}$ row. Consequently, not all of the pixels on the $N^{th}$ row become connected pixel defects, and consequently the deterioration of the image quality can be prevented. Furthermore, since the preliminary charging to the pixels on the $(N+1)^{th}$ row ends before the start of the $N^{th}$ row horizontal scan, not all of the pixels on the $N^{th}$ row become the connected pixel defects, and consequently the deterioration of the image quality can be prevented. Moreover, since preliminary charging is performed while a vertical scan is being performed, the image quality deterioration to an adjacent pixel owing to a feedthrough when a pixel voltage is changed from the positive field to the negative field and vice versa can be decreased.

(Second Embodiment)

Figure 5:
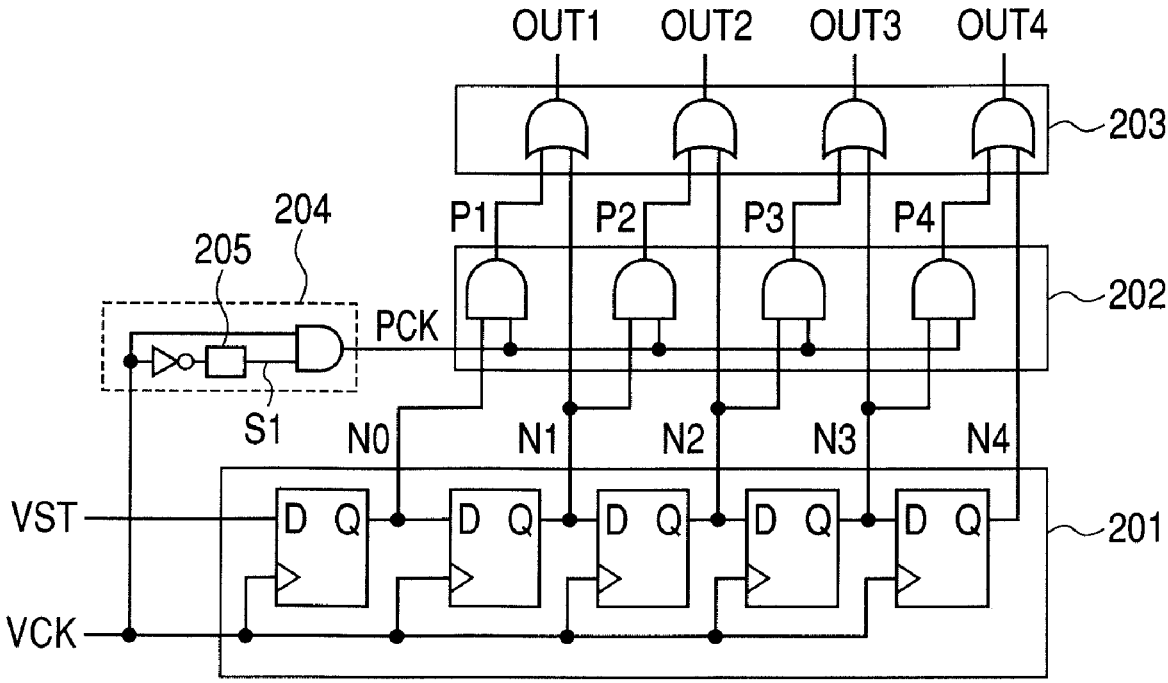
FIG. 5 is a diagram illustrating a configuration example of a vertical scan control circuit in a second embodiment of the present invention.

FIG. 5 is a diagram illustrating a second embodiment of the vertical scan circuit 110 illustrated in FIG. 3. The feature of the present embodiment is that the control clock signal PCK is generated by a third signal generating circuit 204 in the substrate on the basis of the vertical scan clock signal VCK. Because the other parts of the present embodiment are the same as those of the first embodiment except the addition of the third signal generating circuit 204, the descriptions of the other parts are omitted.

Next, the configuration of the third signal generating circuit 204 will be described. The vertical scan clock signal VCK is input into an input terminal of an inverter circuit (hereinafter referred to as INV circuit) and one input terminal of an AND circuit, and an output of the INV circuit is input into the other input terminal of the AND circuit through a delay circuit 205. The delay circuit 205 may be either of (a) an analog delay circuit using a CR time constant circuit composed of a capacitor and a resistor and (b) a digital delay circuit such as the one using the horizontal scan clock signal HCK and flip flop circuits here. It is a matter of course that the delay circuit 205 may be the one composed of serially connected buffer circuits. Moreover, the connection order of the INV circuit and the delay circuit may be reverse.

Figure 6:
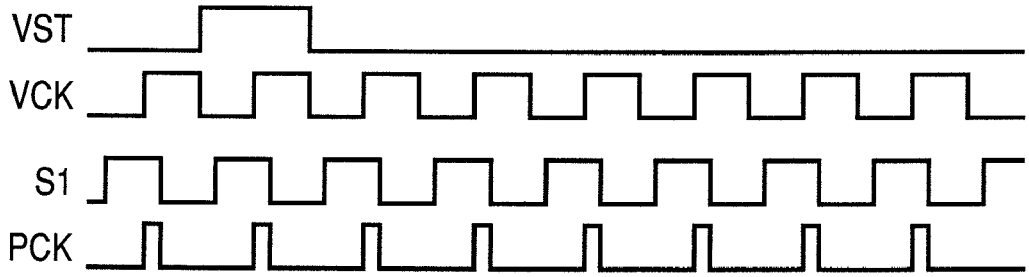
FIG. 6 is a timing chart illustrating an operation example of a control clock signal generating circuit in the second embodiment of the present invention.

FIG. 6 illustrates an operation timing chart of the third signal generating circuit 204 for generating the control clock signal PCK illustrated in FIG. 5. The vertical scan start signal VST, and the vertical scan clock signal VCK are input into the third signal generating circuit 204, and the delay circuit 205 outputs an output signal S1. The vertical scan clock signal VCK is input into the one input terminal of the AND circuit, and the output signal S1 of the delay circuit 205 is input into the other input terminal of the AND circuit. Consequently, the control clock signal PCK is output from the AND circuit. The control clock signal PCK is the output signal of the third signal generating circuit 204. As is known from the timing chart, the delay time of the delay circuit 205 becomes the preliminary charging period of the vertical scan drive.

By using the present embodiment, the same effects as those of the first embodiment can be obtained, and only by the same input signals as those of the related art, the vertical scan circuit 110 capable of performing the preliminary charging operation can be realized.

(Third Embodiment)

Figure 7:
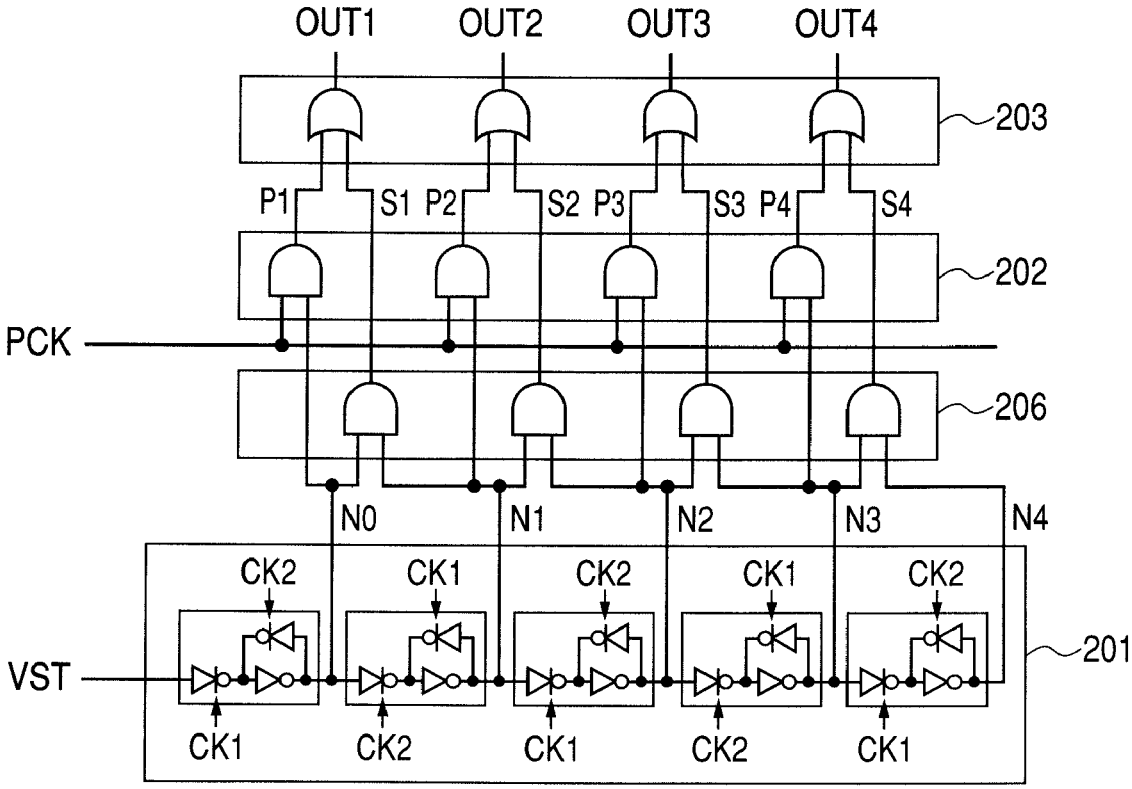
FIG. 7 is a diagram illustrating a configuration example of a vertical scan control circuit in a third embodiment of the present invention.

FIG. 7 is a third embodiment of the vertical scan circuit 110 illustrated in FIG. 3. The vertical scan circuit 110 illustrated in the present embodiment differs from that illustrated in the first embodiment in the following three points: a fourth signal generating circuit 206 is provided between the shift register circuit 201 and the second signal generating circuit 203; the output signals S1-S4 of the fourth signal generating circuit 206 are input into the other input terminals of the AND circuits in the second signal generating circuit 203; and the shift register circuit 201 is made up of latch circuits, each composed of two tri-state inverters and one inverter.

Figure 8:
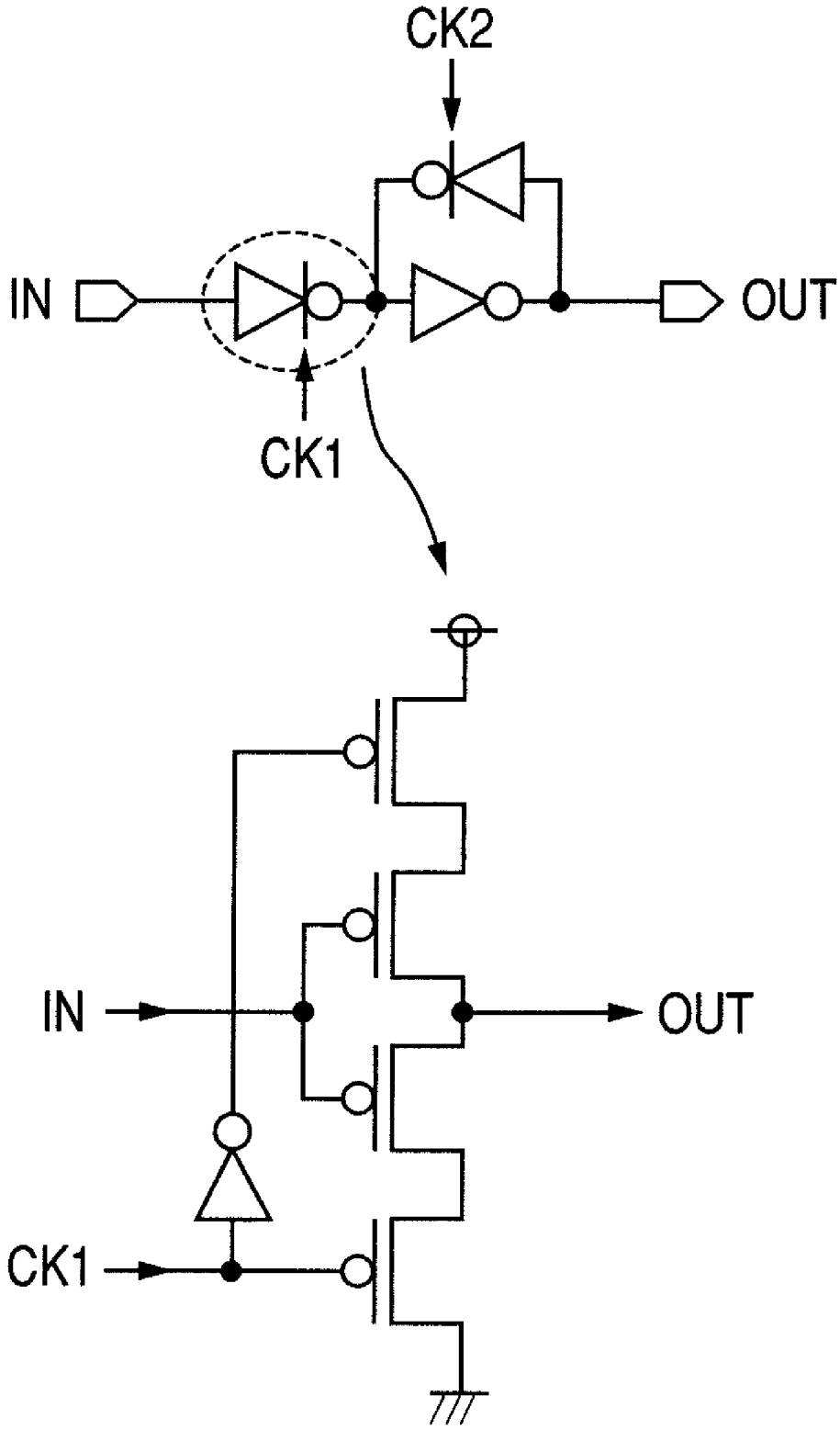
FIG. 8 is a circuit diagram illustrating a configuration example of a latch circuit constituting the vertical scan control circuit in the third embodiment of the present invention.

FIG. 8 illustrates the circuit for one bit of the shift register circuit 201 used in the present embodiment. The circuit enclosed by a dotted line is the so-called tri-state inverter, the output of which is controlled to be high impedance by a control signal CK1, and two tri-state inverters and one inverter constitute one latch circuit.

The shift register circuit 201 illustrated in FIG. 7 is made up of five latch circuits connected in series, the connection points of which are used as the terminals for outputting the output signals N0-N4 of the shift register circuit 201. The control signals CK1 and CK2 input into each of the latch circuits constituting the shift register circuit 201 may be input into the shift register circuit 201 directly from the outside of the active matrix substrate, or may be generated from the vertical scan clock signal VCK illustrated in the first embodiment in the substrate. Incidentally, the control signal CK1 is a non-inversion signal of the vertical scan clock signal VCK, and the control signal CK2 is an inversion signal of the vertical scan clock signal VCK. A changing point of the control signal CK1 and a changing point of the control signal CK2 must not overlap on each other for the sake of the stability of operation. It is desirable that there are periods during which both of the control signals CK1 and CK2 take the low (Low) level.

Incidentally, the control signal CK1 is input into the clock terminals of the tri-state inverters of the latch circuits arranged at odd numbered positions which tri-state inverters operate at the time of taking in data, and the control signal CK2 is input into the clock terminals of the tri-state inverters of the latch circuits arranged at the odd numbered positions which tri-state inverters operate at the time of holding data.

Moreover, the reverse control signals to those input into the latch circuits arranged at odd numbered positions are input into the latch circuits arranged at even numbered positions.

In the shift register circuit 201 composed of the serially connected latch circuits to be used for the present embodiment, the output signals N0 to N4 overlap on each other as if two rows of scan lines are simultaneously scanned. The fourth signal generating circuit 206 extracts the signal during the period in which the output signals N0 and N1 overlap on each other at the first stage AND circuit of the fourth signal generating circuit 206 accordingly in order to turn on only a desired scan line. Similarly, the fourth signal generating circuit 206 extracts the signals during the periods in each of which the output signals N1 and N2, the output signals N2 and N3, and the output signals N3 and N4 severally overlap on each other at the second to fourth stages of the fourth signal generating circuit 206, respectively.

The output signals N0 to N4 of the shift register circuit 201 are input into one terminals of the first to fourth row AND circuits of the first signal generating circuit 202, respectively. Moreover, the control clock signal PCK is input into the other input terminals of all of the AND circuits of the first signal generating circuit 202.

The output signals P1 to P4 of the first signal generating circuit 202 are input into one of input terminals of the respective row OR circuits of the second signal generating circuit 203, respectively. Moreover, the output signals S1 to S4 of the fourth signal generating circuit 206 are input into the other input terminals of the respective row OR circuits of the second signal generating circuit 203. Then, the output signals OUT1-OUT4 of the respective row OR circuits of the second signal generating circuit 203 are output to the scan lines 111 to 114.

Figure 9:
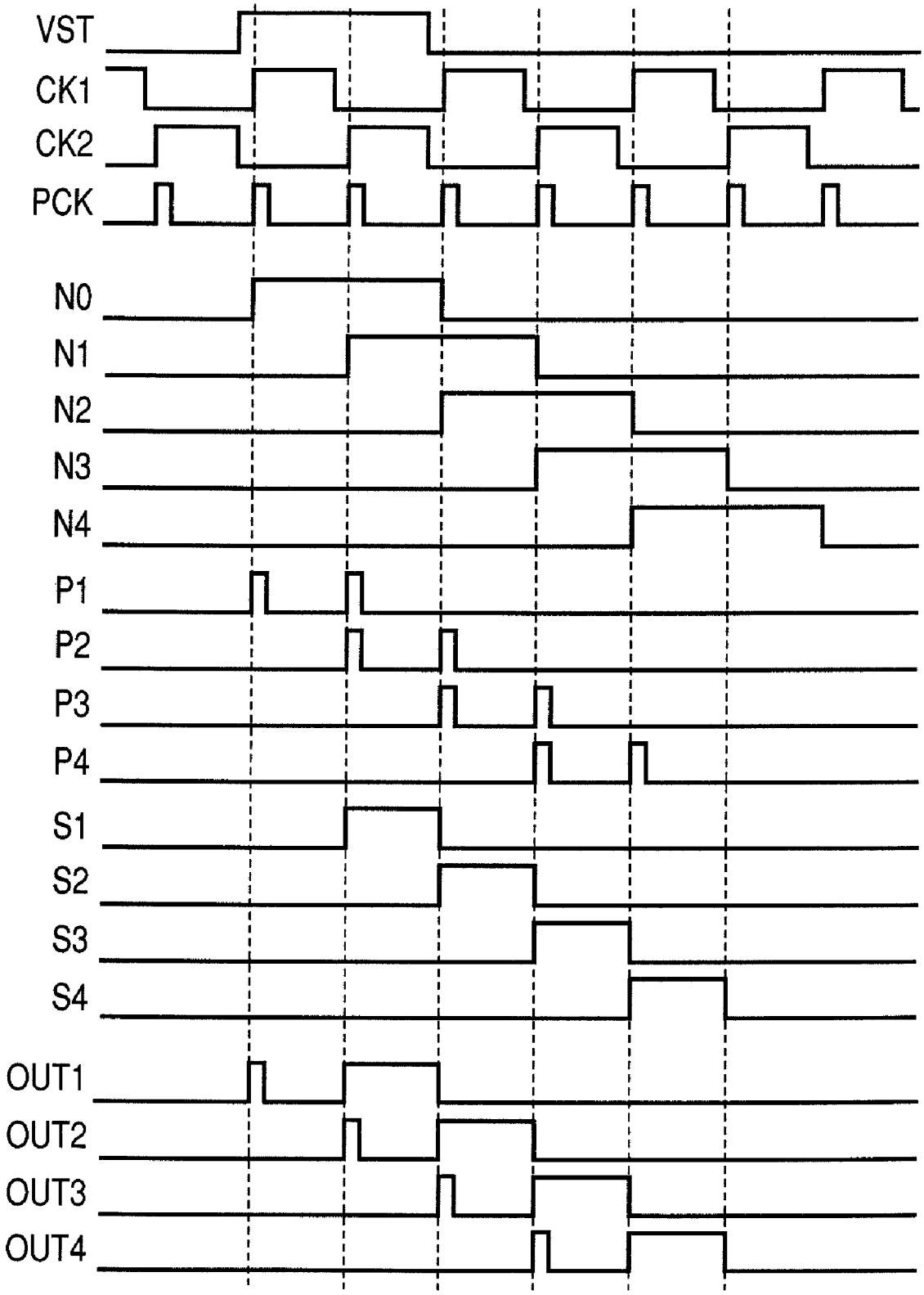
FIG. 9 is a timing chart illustrating an operation example of the vertical scan control circuit in the third embodiment of the present invention.

FIG. 9 is a timing chart illustrating an operation example (drive method) of the vertical scan circuit 110 illustrated in FIG. 7. The vertical scan start signal VST, the control signals CK1 and CK2, and the control clock signal PCK are input into the vertical scan circuit 110. The output signals N0 to N4 are output from the shift register circuit 201. The output signals P1-P4 are output from the AND circuits in the first signal generating circuit 202. The output signals S1-S4 are output from the AND circuits in the fourth signals generating circuit 206. The output signals OUT1 to OUT4 are output from the OR circuits in the second signal generating circuit 203 as the scan signals.

The operation example illustrated in FIG. 9 is different from that of the first embodiment in that two pulses are generated as each of the output signals P1-P4 of the first signal generating circuit 202. By operating the logical sums of output signals P1-P4 and the output signals S1-S4 of the fourth signal generating circuit 206, respectively, with the second signal generating circuit 203, the same scan signals OUT1 to OUT4 as those of the first embodiment can be obtained.

Incidentally, although the present embodiment is configured to input the control clock signal PCK from the outside, it is also possible to generate the control clock signal PCK from the vertical scan clock signal VCK or the control signals CK1 and CK2 in the substrate as described with regard to the second embodiment.

By using the present embodiment, the same effects as those of the first embodiment can be obtained. Furthermore, by configuring the shift register circuit 201 by the use of the latch circuits, the circuit scale of the present embodiment can be made to be smaller than those of the first and second embodiments.

(Fourth Embodiment)

Figure 10:
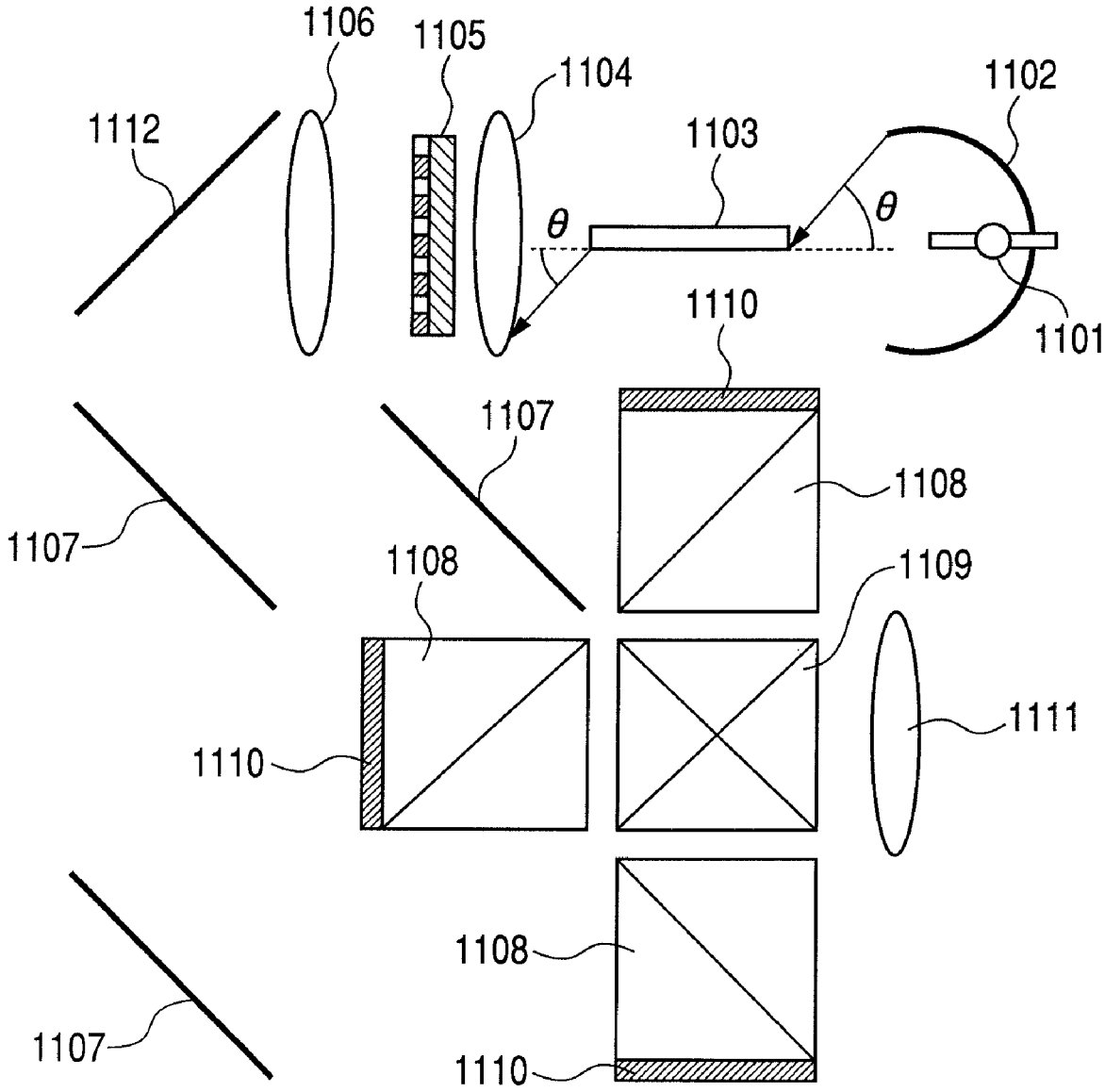
FIG. 10 is a diagram illustrating a configuration example of a liquid crystal projection apparatus in a fourth embodiment of the present invention.

With reference to FIG. 10, a liquid crystal projection apparatus using a reflective liquid crystal display apparatus using the active matrix substrate of the first to third embodiments will be described. FIG. 10 illustrates an example of a liquid crystal projection apparatus according to a fourth embodiment of the present invention. The liquid crystal projection apparatus includes a lamp 1101 (light source), a reflector 1102, a rod integrator 1103, a collimator lens 1104, a polarization conversion system 1105, a relay lens 1106, dichroic mirrors 1107, polarizing beam splitters 1108, a cross prism 1109, reflective liquid crystal panels 1110 using one of the active matrix substrates of the first to third embodiments, a projector lens 1111, and a total reflection mirror 1112.

A light flux that has exited from the lamp 1101 is reflected by the reflector 1102, and is condensed to the entrance of the integrator 1103. The reflector 1102 is an elliptic reflector, and the focal points thereof exist at the light emitting section thereof and the entrance of the integrator 1103. The light flux that has entered in the integrator 1103 repeats reflection in the integrator 1103 up to several times including without any time of reflection, and forms an image of a secondary light source at the outlet of the integrator 1103. As the formation method of the secondary light source, there is also a method of using a fly's eye lens, but the description thereof is omitted here. A light flux from the secondary light source passes through the collimator lens 1104 to be made to substantially a parallel light, and enters the polarizing beam splitter 1105 of the polarization conversion system. The polarized P wave is reflected by the polarizing beam splitter 1105 and passes through a $\lambda/2$ plate to be changed to an S wave. Then all of the polarized waves become the S waves, and the S waves enter the relay lens 1106. The entered light flux is condensed on the reflective liquid crystal panels 1110 by the relay lens 1106. Before the light flux is condensed on the reflective liquid crystal panels 1110, the color separation dichroic mirrors 1107, polarizing plates (not illustrated), the polarizing beam splitters 1108, the cross prism 1109, and the like, constitute a color separation system, and then the S waves severally enter the three liquid crystal panels 1110. In each of the liquid crystal panels 1110, a liquid crystal shutter controls voltages pixel by pixel in accordance with an image. The entered S waves are modulated into elliptically polarized lights (or linearly polarized lights) by the operation of the liquid crystals, and each of the polarizing beam splitters 1108 transmits a P wave component. Thus, after the color synthesis of the light flux is performed by the cross prism 1109, the light flux is projected from the projector lens 1111. Such a form is general.

According to the first to third embodiments, the liquid crystal display apparatuses severally use an active matrix substrate including a switching transistor in each pixel and being capable of obtaining a high quality output image, and the active matrix substrate includes the vertical scan circuit 110 capable of a high speed operation.

Since the liquid crystal display apparatus ends the preliminary charging to the pixels on the $(N+1)^{th}$ row before the start of the horizontal scan of the $N^{th}$ row, no connected pixel defects are caused, and the liquid crystal display apparatus can prevent the deterioration of the image quality thereof. Moreover, the liquid crystal display apparatus performs the vertical scan of the preceding row while performing preliminary charging of the next row, the liquid crystal display apparatus can decrease the image quality deterioration owing to a feedthrough to an adjacent pixel when a pixel voltage changes from the positive field to the negative field and vice versa.

The liquid crystal display apparatuses of the first to third embodiments severally include pixels 100, the scan lines 111-114, and the vertical scan circuit 110. Each of the pixels 100 includes a pixel electrode for applying a voltage to the liquid crystal 104 between the pixel electrode and the counter electrode, and the switch element 101 connected to the pixel electrode. The plurality of the pixels 100 is arranged in a matrix. Each of the scan lines 111-114 is commonly connected to a plurality of switch elements 101 in a row direction, and the plurality of scan lines 111-114 is arranged in a column direction. The vertical scan circuit 110 supplies the scan signals OUT1 to OUT4 for controlling the conducting states and the non-conducting states of the switch elements 101 to the scan lines 111-114, respectively, and scan the pixels 100 scan line by scan line in order.

Each of the scan signals OUT1-OUT4 includes a first conducting signal setting the switch elements 101 to be in their conducting states, a second conducting signal setting the switch elements 101 to be in their conducting states following the first conducting signal, and a non-conducting signal setting the switch elements to be in their non-conducting states between the first and second conducting signals. The first conducting signal is, for example, the first high level pulse of the output signal OUT2 of FIG. 2. The second conducting signal is, for example, the second high level pulse of the output signal OUT2 of FIG. 2. The non-conducting signal is, for example, the low level signals following the first high level pulse of the output signal OUT2 of FIG. 2.

The vertical scan circuit 110 supplies, for example, the first conducting signal and non-conducting signal of the scan signal OUT3 to the scan line 113, which is scanned next to the predetermined scan line 112, while the second conducting signal of the scan signal OUT2 is being supplied to the predetermined scan line 112. The first conducting signal supplied to the scan line 113 is, for example, the first high level signal of the output signal OUT3 of FIG. 2. The non-conducting signal supplied to the scan line 113 is, for example, the low level signal after the first high level pulse of the output signal OUT3 of FIG. 2.

The vertical scan circuit 110 supplies the second conducting signal (for example, the second high level pulse of the output signal OUT3 of FIG. 2) to the scan line 113, which is scanned next to the predetermined scan line 112, after the period in which the second conducting signal of the scan signal OUT2 is supplied to the predetermined scan line 112. The liquid crystal display apparatus includes the signal lines 121 to 124 connected to the pixel electrodes through the switch elements 101, the transfer switches 131 to 134 controlling the connections between the video signal line 150 and the signal lines 121 to 124, and the horizontal scan circuit 140. The horizontal scan circuit 140 sets the transfer switches 131 to 134 to the conducting states in order while a non-conducting signal is being supplied to the scan line 113, which is scanned next to the predetermined scan line 112.

As illustrated in FIG. 4, the vertical scan circuit 110 includes the shift register circuit 201, the first signal generating circuit 202, and the second signal generating circuit 203. The first signal generating circuit 202 outputs the logical product signals (output signals P1 to P4) based on the output signals of the shift register circuit 201 and the control clock signal PCK. The second signal generating circuit 203 outputs the scan signals OUT1 to OUT4, which are the logical sum signals based on the logical product signals of the first signal generating circuit 202 and the output signals of the shift register circuit 201.

Moreover, as illustrated in FIG. 5, the vertical scan circuit 110 supplies the scan signals OUT1 to OUT4 on the basis of the vertical scan clock signal VCK. The liquid crystal display apparatus further includes the third signal generating circuit 204 outputting the control clock signal PCK to the first signal generating circuit 202 on the basis of the signal that is the vertical scan clock signal VCK delayed by the delay circuit 205.

The delay circuit 205 is (a) an analog delay circuit using a CR time constant circuit including a capacitor and a resistor or (b) a digital delay circuit using flip flop circuits.

Moreover, the liquid crystal projection apparatus of FIG. 10 includes one of the liquid crystal display apparatuses (reflective liquid crystal panel) 1110 according to the first to third embodiments, and the light source (lamp) 1101 for emitting a light to the liquid crystal display apparatus 1110, and projects the reflected light from the liquid crystal display apparatus 1110.

By the present invention, the deterioration of the image quality owing to the parasitic capacitance coupling between pixel electrodes or a feedthrough between pixels can be suppressed, and the deterioration of the image quality owing to the occurrence of a pixel defect over a plurality of rows can be suppressed.

Incidentally, all of the embodiments described above are only the concrete examples at the time of implementing the present invention, and the technical scope of the present invention should not be interpreted in a limited way. That is, the present invention can be implemented in various forms without departing from the technical concept or the chief features thereof.

This application claims the benefit of Japanese Patent Application No. 2008-018063, filed Jan. 29, 2008, which is hereby incorporated by reference herein in its entirety.

What is claimed is:

1. A liquid crystal display apparatus comprising:

a plurality of pixels arranged in a matrix, wherein each of the pixels includes a switching element connected to a pixel electrode for applying a voltage to a liquid crystal placed between the pixel electrode and a counter electrode;

a plurality of scan lines arranged in a column direction, wherein each of the scan lines is connected commonly to the plurality of switching elements arranged in the row direction; and a vertical scan circuit configured to supply the scan line with a scan signal, generated based on a vertical scan clock signal, to control the switch element between a conducting state and a non-conducting state, and for scanning the pixels scan line by scan line sequentially, wherein the scan signal includes a first conducting signal setting the switch element at the conducting state, a second conducting signal setting the switch element at the conducting state following to the first conducting signal, and a non-conducting signal setting the switch element at the non-conducting state between the first and second conducting signals, and wherein the vertical scan circuit supplies a predetermined scan line with the second conducting signal, wherein the vertical scan circuit supplies to the other scan line which is scanned next to the predetermined scan line with the non-conducting signal after the supply of the first conducting signal to the other scan line and before the end of the supply of a voltage based on a video signal to the pixel on a predetermined row on which a plurality of switching elements commonly connected to the predetermined scan line are arranged during a period in which the second conducting signal is supplied to a predetermined scan line, and wherein the vertical scan circuit comprises a shift register circuit, a first signal generating circuit configured to output a logical product signal based on a control clock signal and an output signal from the shift register, a second signal generating circuit configured to output a logical sum signal as the scan signal generated based on the logical product signal and the output signal from the shift register, and a third signal generating circuit configured to generate the control clock signal based on a signal generated by delaying the vertical clock signal through a delay circuit and to supply the control clock signal to the first signal generating circuit.

2. The liquid crystal display apparatus according to claim 1, wherein after a time period of supplying the predetermined scan line with the second conducting signal, the vertical scan circuit supplies, with the second conducting signal, the other scan line to be scanned next to the predetermined scan line.

3. The liquid crystal display apparatus according to claim 2, further comprising:

a signal line connected through the switch element to the pixel electrode, a transfer switch for controlling a connection between the signal line and a video signal line, and a horizontal scan circuit, wherein the horizontal scan circuit sets the transfer switch to at a conducting state and the vertical scan circuit supplies the non-conducting signal to the other scan line to be scanned next to the predetermined scan line.

4. The liquid crystal display apparatus according to claim 1, wherein the delay circuit is an analog delay circuit using a time constant circuit comprising a capacitor and a resistor, or a digital delay circuit using a horizontal scan clock signal and a flip-flop circuit.

5. A liquid crystal projection apparatus comprising: a liquid crystal display apparatus according to claim 1; and a light source, wherein the liquid crystal projection apparatus projects an image formed by modulating light emitted from the light source through the liquid crystal display apparatus.

6. A liquid crystal display apparatus comprising:

a plurality of pixels arranged in a matrix, wherein each of the pixels includes a switching element connected to a pixel electrode for applying a voltage to a liquid crystal placed between the pixel electrode and a counter electrode;

a plurality of scan lines arranged in a column direction, wherein each of the scan lines is connected commonly to the plurality of switching elements arranged in the row direction; and vertical scan means for supplying the scan line with a scan signal, generated based on a vertical scan clock signal, for controlling the switch element between a conducting state and a non-conducting state, and for scanning the pixels scan line by scan line sequentially, wherein the scan signal includes a first conducting signal setting the switch element at the conducting state, a second conducting signal setting the switch element at the conducting state following to the first conducting signal, and a non-conducting signal setting the switch element at the non-conducting state between the first and second conducting signals, and wherein the vertical scan means supplies a predetermined scan line with the second conducting signal, wherein the vertical scan means supplies to the other scan line which is scanned next to the predetermined scan line with the non-conducting signal after the supply of the first conducting signal to the other scan line and before the end of the supply of a voltage based on a video signal to the pixel on a predetermined row on which a plurality of switching elements commonly connected to the predetermined scan line are arranged during a period in which the second conducting signal is supplied to a predetermined scan line, and wherein the vertical scan means comprises a shift register circuit, a first signal generating means for outputting a logical product signal based on a control clock signal and an output signal from the shift register, a second signal generating means for outputting a logical sum signal as the scan signal generated based on the logical product signal and the output signal from the shift register, and a third signal generating means for generating the control clock signal based on a signal generated by delaying the vertical clock signal through a delay circuit and for supplying the control clock signal to the first signal generating means.

* * * * *